US006079111A

United States Patent [19]

Williams et al.

[11] Patent Number: 6,079,111

[45] Date of Patent: Jun. 27, 2000

[54] SIGHT APPARATUS FOR ARCHERY BOW HAVING RANGE FINDER AND PENDULOUS SIGHT

[76] Inventors: Ronald R. Williams, 1117 NW. 176th, Edmond, Okla. 73003; W. Lincoln Barr, R.R. #2, Box 11B, Dover, Okla. 73734

[21] Appl. No.: 08/752,350

[22] Filed: Nov. 19, 1996

[51] Int. Cl.[7] ..... F41G 1/467

[52] U.S. Cl. ..... 33/265; 33/284; 124/87

[58] Field of Search ..... 33/265, 284; 124/87, 124/86

[56] References Cited

U.S. PATENT DOCUMENTS

| | | | |
|---|---|---|---|
| 3,013,336 | 12/1961 | Pennington | 33/265 |
| 3,212,190 | 10/1965 | Larson | 33/265 |
| 3,945,127 | 3/1976 | Spencer | 33/265 |
| 4,120,096 | 10/1978 | Keller | 33/265 |
| 4,136,462 | 1/1979 | Topel | 33/265 |
| 4,368,581 | 1/1983 | Tullos | 33/265 |
| 4,400,887 | 8/1983 | Mason | 33/265 |
| 4,473,959 | 10/1984 | Saltzman | 33/265 |
| 4,514,907 | 5/1985 | Saltzman | 33/265 |
| 4,535,544 | 8/1985 | Jones et al. | 33/265 |
| 4,580,349 | 4/1986 | Webb et al. | 33/265 |
| 4,669,196 | 6/1987 | Kersey | 33/265 |
| 4,720,919 | 1/1988 | Saunders | 33/265 |
| 4,796,364 | 1/1989 | Amacker | 33/265 |
| 4,884,347 | 12/1989 | Larson | 33/265 |
| 4,995,166 | 2/1991 | Knemeyer | 33/265 |
| 5,092,052 | 3/1992 | Godsey | 33/265 |
| 5,121,547 | 6/1992 | Littlejohn | 33/265 |
| 5,253,423 | 10/1993 | Sullivan, Jr. et al. | 33/265 |
| 5,651,185 | 7/1997 | Vanderheyden et al. | 33/265 |
| 5,914,775 | 6/1999 | Hargrove et al. | 356/3.13 |

OTHER PUBLICATIONS

Gander Mountain, Archery 1995, supplies catalog, pp. 44–55, 1995.

Bowhunters Discount Warehouse, Inc. supplies catalog, pp. 89–102, 1994.

"What is a Range Tamer?", Bowsight, Inc. literature, 7 pages, Apr. 1994.

*Primary Examiner*—Andrew H. Hirshfeld
*Assistant Examiner*—R. A. Smith
*Attorney, Agent, or Firm*—Dunlap, Codding & Rogers, P.C.

[57] ABSTRACT

A sight apparatus for an archery bow which compensates for both the distance to a target and the elevation of the target. The sight apparatus includes a range finder mechanism and a pendulous sight. The range mechanism and the pendulous sight are operatively connected such that the setting for the range to a target positions the pendulous axis. The pendulous sight has a sight element which is suspended from the corresponding pendulous axis to provide a point of aim at the target. The range mechanism includes an adjustment arm which is pivotable to a known or estimated distance. The range mechanism also includes a pair of bracketing pins wherein one of the bracketing pins is movable relative to the other bracketing pin along an arc shaped travel path for bracketing the target and providing a range setting determined from the size of the target.

5 Claims, 10 Drawing Sheets

SIGHT APPARATUS FOR ARCHERY BOW HAVING RANGE FINDER AND PENDULOUS SIGHT

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention.

The present invention relates generally to sighting devices for use with an archery bow, and more particularly, but not by way of limitation, to an improved sight apparatus for an archery bow which employs an adjustable range finder in combination with a pendulum sight to compensate for elevational differences between the bow and the target.

2. Brief Description of the Related Art.

Hunters who use an archery bow and arrow must overcome several obstacles to take game consistently. These obstacles include accurately estimating range and target size and in turn positioning the bow to shoot at the proper angle of shot. Unless one possesses superior skill and instinct, a sight apparatus is normally utilized on the bow to aid the bowhunter in properly aiming the arrow at the intended target.

Many sight apparatuses have been proposed in the past. The most common type of sight apparatus utilizes a plurality of spaced apart horizontal sight pins. Each of the pins represents a particular distance. Thus, the arrow is properly aimed at a target when distance to the target is known and the corresponding pin is aligned with the target. The problem encountered is that a hunter must know the exact distance to the target or be able to accurately estimate the distance in order to use the correct sight pin.

In an attempt to increase a hunter's shooting accuracy by eliminating distance estimation, combination range finders and sights have been proposed which employ adjustable range finder pins between which the target is framed to obtain the proper shot angle. One such device is disclosed in U.S. Pat. No. 4,995,166, issued to Knemeyer. The Knemeyer patent discloses a sight pin positioned between a top range finder pin and a bottom range finder pin which are moved together or apart to frame the target. As the top and bottom range finder pins are moved to frame the target the sight pin travels along a vertical path to a position where the proper trajectory is obtained when the sight pin is aligned with the target.

While this particular device has met with some success, problems have nevertheless been encountered with use of the Knemeyer device. In particular, the linear travel path of the range finder pins do not allow the range finder pins to be easily adjusted for targets having different heights. Instead, parts must be inconveniently interchanged in order to use the device for targets of different sizes, or the archer must attempt to compromise for the difference in the height of the target by aiming higher or lower than the sight pin indicates depending on whether the target is taller or shorter than the height of the target the device is set up to shoot.

In that a hunter cannot count on game, such as deer or elk, traveling along a path to which the hunter knows the distance, and an inaccurate estimation of the distance to the target will result in missing the target, bowhunters often use equipment that causes the arrow to travel along a flatter trajectory thereby reducing the need to accurately estimate the distance to the target. Such equipment includes a bow strung at high poundage, speed cams, fast flight strings, a greater let off at full draw, and light weight arrows.

The features mentioned above have their drawbacks which a hunter may or may not wish to accept. Increased bow poundage can cause less hold time and less control. Radical cams and lighter weight arrows cause increased vibration and noise which can alert game and affect arrow flight. For these and other reasons, it is desirable to use a bow with lower poundage and heavier arrows.

Another problem encountered while hunting with an archery bow is that the hunter and the target are often not on the same horizontal plane. That is, the hunter may be positioned in a treestand or on a hillside wherein the target is positioned below the hunter. Conversely, it may be that the target is positioned above the hunter. To compensate for the difference in elevation, a class of sight commonly known as the pendulum sight has been used. Prior art pendulum sights have been limited in range due to the fact that the pivot point of the pendulum is fixed. When shooting from an elevated position of about 15 feet and at a target at relatively close range, 15 yards for example, the pendulum sight remains at true vertical thus adjusting the tilt of the bow to shoot on a flatter trajectory than required for a non-elevated shot. If the range is increased by 10 yards, the angle of the pendulum relative to the bow is changed by a certain number of degrees. Because the change in angle is significant between a distance of 15 yards and 25 yards, the pendulum sight remains fairly accurate. However, if the range is increased another 10 yard increment, the angle of change is approximately one half the previous angle of change and thus the needed movement of the pendulum drops by half. Because the angle of change is decreased with each subsequent increase in target range, the prior art pendulum sights are rendered ineffective beyond certain distances and below certain heights and thus require some type of conventional sighting system when shooting on a non-elevated plane which is operated separately from the pendulum sight.

To this end, an improved sight apparatus has long been needed which enables an archer to quickly and accurately determine the range to a target and in turn position the bow for the proper arrow trajectory regardless of the elevation between the archer and the target and which is quickly and easily adjustable for use on targets of various sizes. It is to such an improved sight apparatus that the present invention is directed.

BRIEF SUMMARY OF THE INVENTION

The present invention is directed to an archery bow sight which is readily adjustable to compensate for both the distance and the elevation of the target. An archery bow sight constructed in accordance with the present invention includes a base plate, a range finder and a pendulous sight.

The pendulous sight is operatively connected to the range finder such that the pendulous sight, including its axis for pendulous movement, is repositioned in response to adjustment of the range finder. Thus, the range finder and the pendulous sight cooperate to compensate for both the distance to a target and the elevation of the target. The range finder is quickly and easily adjustable for use on targets of various sizes.

The objects, features and advantages of the present invention will become apparent from the following detailed description when read in conjunction with the accompanying drawings and appended claims.

DETAILED DESCRIPTION OF THE INVENTION

Figure 1:
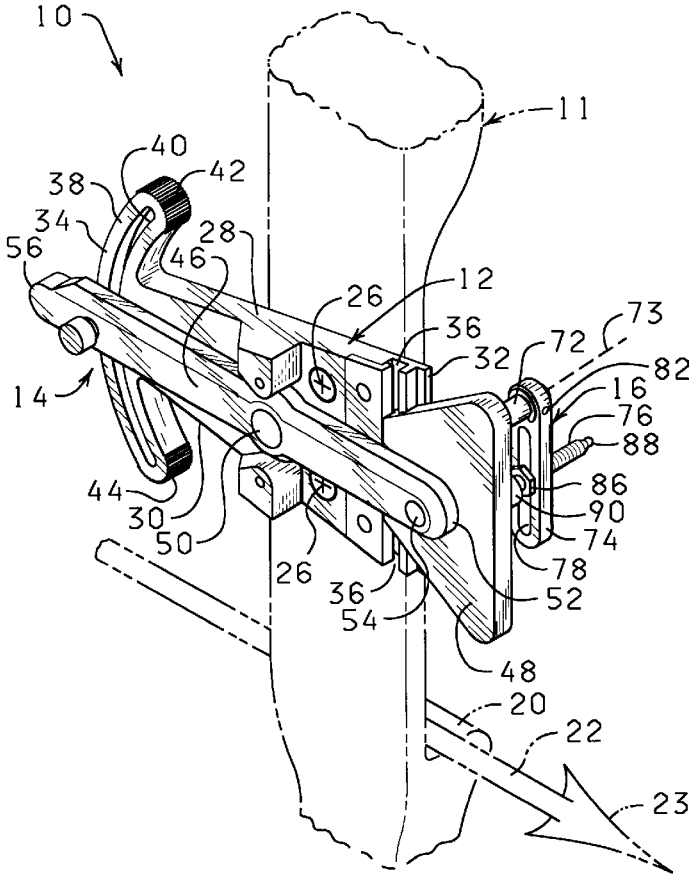
FIG. 1 is a perspective view of a sight apparatus constructed in accordance with the present invention shown attached to an archery bow.

Referring now to the drawings and more particularly to FIGS. 1–4, a sight apparatus 10 constructed in accordance with the present invention is shown attached an archery bow 11. The sight apparatus 10 includes a base plate 12, a range mechanism 14, and a pendulous sight 16.

The archery bow 11 is provided with an arrow rest 20 which is illustrated supporting an arrow 22 with an arrowhead 23. The base plate 12 is attached to the bow 11 by any suitable means known in the art, such as a pair of threaded bolts 26 (FIG. 1).

With reference to FIG. 1, the base plate 12 has an upper end 28, a lower end 30, a front end 32, and a rear end 34. The front end 32 of the base plate 12 is provided with a guide slot 36 which extends from the upper end 28 to the lower end 30 of the base plate 12. The rear end 34 of the base plate 12 is provided with an arc portion 38 having a curved slot 40. The arc portion 38 has a ribbed upper portion 42 and a ribbed lower portion 44 to facilitate gripping the base plate 12 between the thumb and a finger.

The range mechanism 14 includes an adjustment arm 46 and a slide plate 48. The adjustment arm 46 extends generally between the front end 32 and the rear end 34 of the base plate 12 and is pivotally mounted to the base plate 12 with a pivot pin 50 or the like. The adjustment arm 46 has a front end 52 which is pivotally connected to the slide plate 48 with a pivot pin 54, and the adjustment arm 46 has a rear end 56 which swings along the arc portion 38 of the base plate 12 as the adjustment arm 46 is pivoted.

Figure 2:
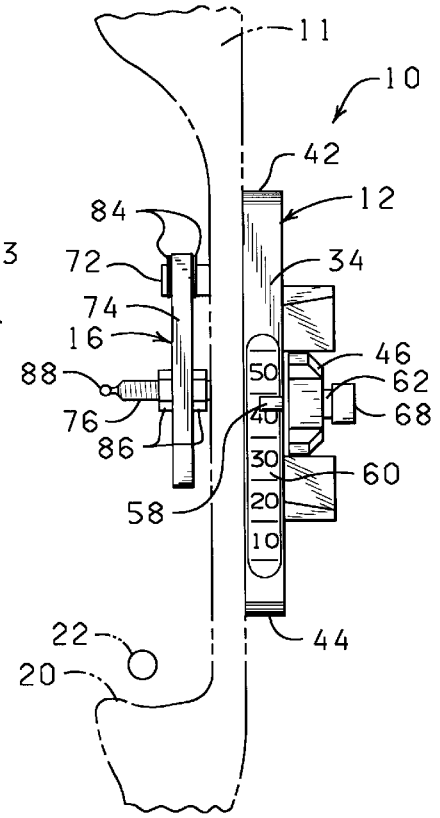
FIG. 2 is a rear view of the sight apparatus of FIG. 1 illustrating an archer's perspective of the sight apparatus when the bow is in a shooting position.

As best shown in FIG. 2, the adjustment arm 46 is provided with a range pointer 58 which extends from the adjustment arm 46 to the rear of the arc portion 38 of the base plate 12. An indicia strip 60 having numerals corresponding to distances ("50", "40", "30", "20" and "10", for 50 to 10 yards, for example) is disposed on the rear surface of the arc portion 38 of the base plate 12 to function in cooperation with the range pointer 58 of the adjustment arm 46 to indicate the distance setting of the sight apparatus 10.

A set bolt 62 (FIGS. 2–4) extends through the adjustment arm 46 and the curved slot 40 into a set nut 64, which is disposed in a channel 66 of the curved slot 40. The set bolt 62 includes a set knob 68 (FIG. 2) which allows an archer to tighten the set bolt 62 and set nut 64 and clamp the adjustment arm 46 to the base plate 12 at a selected distance setting.

Figure 3:
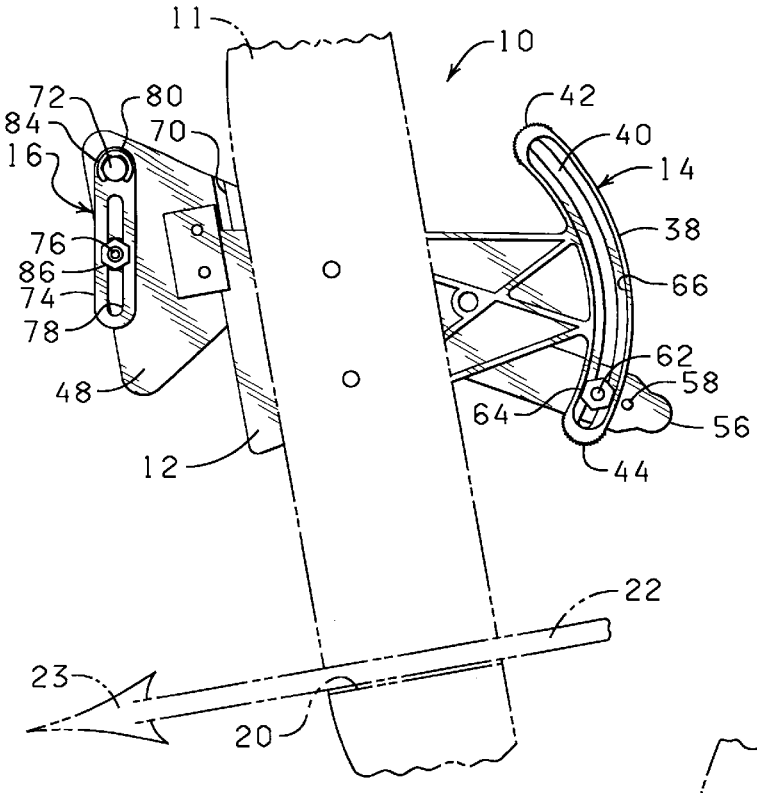
FIG. 3 is a side view of the sight apparatus of FIG. 1 illustrating the sight apparatus set for a short range target which is located below the elevation of the arrow.
Figure 4:
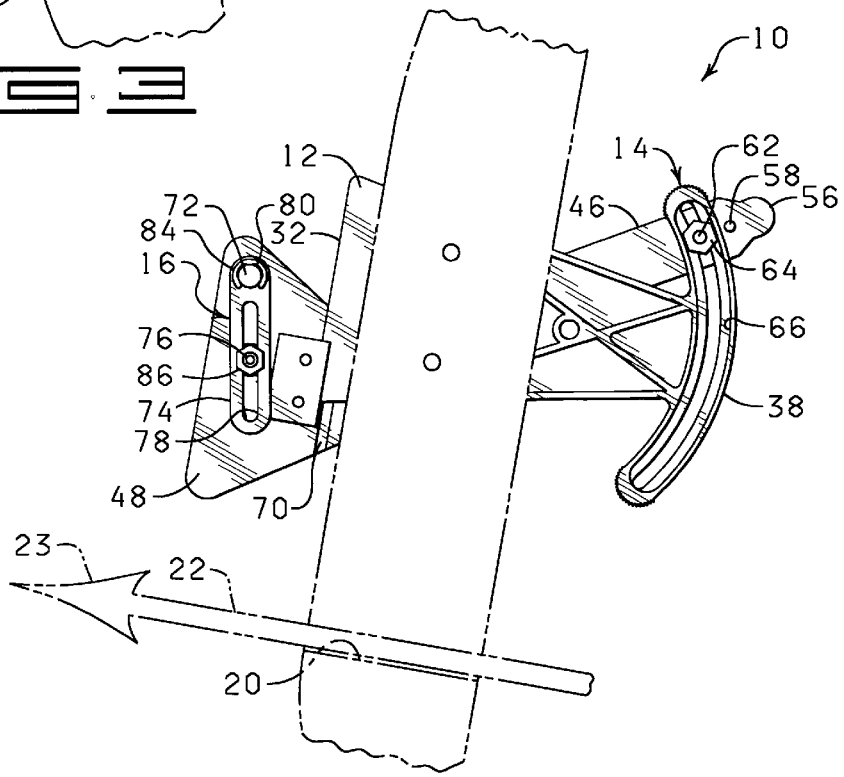
FIG. 4 is a side view of the sight apparatus of FIG. 1 illustrating the sight apparatus set for a long range target which is located above the elevation of the arrow.

As shown in FIGS. 3 and 4, the slide plate 48 includes a guide member 70 which projects from the slide plate 48 toward the base plate 12. The guide member 70 extends from the top to the bottom of the slide plate 48.

The guide slot 36 of the base plate 12 and the guide member 70 of the slide plate 48 are shaped such that the guide slot 36 receives the guide member 70 and the guide member 70 slides through the guide slot 36. Thus, the guide slot 36 defines a track for reciprocating movement of the slide plate 48 with respect to the base plate 12. The guide slot 36 and the guide member 70 may have any suitable shape. For example, the lateral cross-sections of the guide slot 36 and guide member 70 may have either a dove-tail or T-shape. With either of these shapes, the guide member 70 is kept from moving laterally out of the guide slot 36, but is free to slide length-wise through the guide slot 36.

The pendulous sight 16 includes a support arm 72 which defines a pivot or pendulum axis 73, a pendulous member 74, and a sight element 76. The pendulous member 74 has an elongated ovate shape and is provided with a lengthwise slot 78, a bore 80, and a set screw hole for receiving a set screw 82.

The support arm 72 is mounted to the slide plate 48 to suspend the pendulous member 74 over the arrow 22. The support arm 72 may be connected to the slide plate 48 in any suitable fashion. For example, the support arm 72 may be rigidly attached to the slide plate 48 in any known manner or may be cast or molded as an integral part of the slide plate 48. Alternatively, the support arm 72 may be threadingly mounted to the slide plate 48 to enable the distance the support arm 72 extends from the slide plate 48 to be adjusted.

The support arm 72 is journaled through the bore 80 of the pendulous member 74 to suspend the pendulous member 74 over the arrow 22. A pair of E-rings 84 are provided to keep the pendulous member 74 in proper position on the support arm 72. As shown in FIG. 2, one of the E-rings 84 is secured on the support arm 72 on each side of the pendulous member 74. It should be appreciated that the E-rings 84 are placed to allow free pendulous movement of the pendulous member 74 with the support arm 72.

The sight element 76 utilized may be a threaded sight pin which is inserted through the slot 78 of the pendulous member 74 and secured in place by a pair of nuts 86. With this construction, the distance the sight element 76 extends from the pendulous member 74 may be adjusted to compensate for windage by loosening the nuts 86, repositioning the sight element 76 and tightening the nuts against both sides of the sight element 76. The relative position of the sight element 76 in the slot 78 of the pendulous member 74 may also be adjusted in this manner. Thus, the position of the sight element 76 may be adjusted laterally at the connection of the support arm 72 to the slide plate 48, at the E-rings 84, or at the nuts 86.

The sight element 76 includes a sight bead 88 operatively connected to a battery 90 (FIG. 1) for illuminating the sight bead 88. This type of battery-powered sight element 76 is known in the art and any of such other types of sight elements may be employed with the sight apparatus 10. The sight bead 88 may also be coated or painted to be luminescent or phosphorescent to enhance the visibility of the sight bead 88 in low light conditions. It should be appreciated that any other type of sight having at least one pendulous sight element may be utilized with the sight apparatus 10. Suitable sight elements include, but are not limited to, any conventional sights using multiple sight pins, one or more vertical cross-hairs and/or one or more horizontal cross-hairs.

Due to the pivot connection of the adjustment arm 46 to the base plate 12 via the pivot pin 50, as the rear end 56 of the adjustment arm 46 is moved to a selected range setting, the slide plate 48 moves up or down to reposition the pendulous sight 16 including the pendulous axis 73 defined by the support arm 72.

It should be understood that the pendulous member 74 is normally allowed to move freely in a pendulous manner. Thus, the set screw 82 is normally not tightened down to prevent pendulous movement of the pendulous member 74. However, the set screw 82 may be screwed down into tight engagement with the support arm 72 to prevent pendulous movement of the pendulous member 74. With the pendulous member 74 locked by the set screw 82, the sight apparatus 10 may be used as a non-pendulous sight.

Operation

Every bow and arrow combination has certain shooting characteristics which are affected by the speed of the bow and the flight pattern of the type of arrow used. Thus, an initial setup for a particular bow and arrow combination should be performed in order to shoot accurately with the sight apparatus 10.

The initial setup is performed according to the following procedure. First, an adhesive strip having indicia of distance is obtained. In FIG. 2, the indicia strip 60 is shown already attached to the sight apparatus 10. Next, a distance is selected for the initial setup. For example, the distance of 30 yards may be selected. Then, a target is positioned at the distance of 30 yards from the shooting spot and at substantially the same elevation as the arrow 22.

The adjustment arm 46 of the sight apparatus 10 is locked at a selected position and arrows are shot at the target. If the arrows hit the target, then the adjustment arm 46 is properly positioned for the 30-yard distance. Therefore, the indicia strip 60 is secured to the rear end 34 of the base plate 12 of the sight apparatus 10 with the numeral "30" under the pointer 58 of the adjustment arm 46. If the arrows miss the target, then the adjustment arm 46 is locked to another position and more arrows are shot at the target. These steps are repeated until the arrows hit the 30-yard target consistently.

The setup procedure may be repeated for other distances to verify the calibration. If the numerals on the indicia strip 60 are not properly spaced, it may be necessary to begin with a blank strip 60 and write the yardage numerals on the strip 60 as the calibration is done for each distance. It should be appreciated that another setup need be performed only if a change is made to alter the shooting characteristics of the bow and arrow combination. For example, the sight apparatus 10 should be recalibrated if the speed of the bow is modified or if arrows with a differing flight pattern are to be shot.

The operation of the sight apparatus 10 is best understood with reference to FIGS. 3 and 4. In short, the sight apparatus 10 is operated by setting the adjustment arm 46 according to the estimated distance to a target thereby positioning the pendulum axis 73 defined by the support arm 72 and allowing the pendulous sight 16 to provide a point of aim which is adjusted for both distance and elevation.

FIG. 3 shows the adjustment arm 46 positioned near the lower end of the arc portion 38 of the base plate 12 which is for a target at short range. This position of the adjustment arm 46 causes the slide plate 48 and support arm 72 to be located at an upper position relative to the base plate 12 thereby resulting in the sighting element 76 being positioned for a relatively flat trajectory.

In the situation illustrated by FIG. 3, the target is at a lower elevation than the direct line defined by the arrow 22. Therefore, the bow 11 is angled downward. However, the pendulous member 74 remains plumb thereby positioning the sight bead 88 at a point of aim at the target which is adjusted for the difference in elevation. That is, because the sight element 88 remains plumb, the sight element 88 is positioned higher than would be a non-pendulous sight bead. The higher position of the sight bead 88 causes the archer to rotate the bow 11 downward so as to decrease the trajectory of the arrow, and in turn, compensate for the difference in elevation.

FIG. 4 shows the adjustment arm 46 positioned near the upper end of the arc portion 38 of the base plate 12 for a target at longer range. This position of the adjustment arm 46 causes the slide plate 48 and support arm 72 to be located at a lower position relative to the base plate 12 thereby resulting in the sighting element 76 being positioned where the bow 11 will be tilted upward when the sight element 76 is aligned with the target to produce a higher trajectory.

For the case illustrated by FIG. 4, the target is at a higher elevation than the elevation of the drawn arrow 22. Therefore, the bow 11 is angled in an upward direction. However, the pendulous member 74 remains plumb thereby positioning the sight bead 88 at a point of aim at the target which is adjusted for the difference in elevation. That is, because the sight element 88 remains plumb, the sight element 88 is positioned lower than would be a nonpendulous sight bead. The lower position of the sight bead 88 causes the archer to increase the upward angle of the bow 11 so as to increase the trajectory of the arrow, and in turn, compensate for the difference in elevation.

It will be appreciated that while the sight apparatus 10 requires distance to the target to be estimated, it provides a point of aim which is adjusted for the distance of a target by a simple range setting of the adjustment arm 46. Further, the sight apparatus 10 provides a point of aim which is correctly compensated for the elevation of the target relative to the sight apparatus 10.

Embodiment of FIGS. 5–9

Referring now to FIGS. 5–9, a sight apparatus 10*a* constructed in accordance with the present invention is shown attached to the archery bow 11. The sight apparatus 10*a* comprises a housing 92, a pair of bracket pins 94, a pendulum arm 95 supporting a pendulous sight 16*a*, and a trigger plate 96. The housing 92 includes an upper wall 100, a lower wall 102, a first side wall 104 and a second side wall 106. The walls 100, 102, 104 and 106 of the housing 92 are secured together with screws 108 or with any other suitable fasteners.

The sight apparatus 10*a* is attached to the bow 11 by means of a mounting plate 109, which is attached to the bow 11 by any suitable means, such as a plurality of screws (not shown). The mounting plate 109 is provided with a pair of mounting slots 110 located for attachment of the first side wall 104 of the housing 92 to the mounting plate 109 with any suitable threaded lugs or bolts and lock nuts (not shown). In this manner, the position of the housing 92 relative to the mounting plate 109 may be adjusted.

Figure 6:
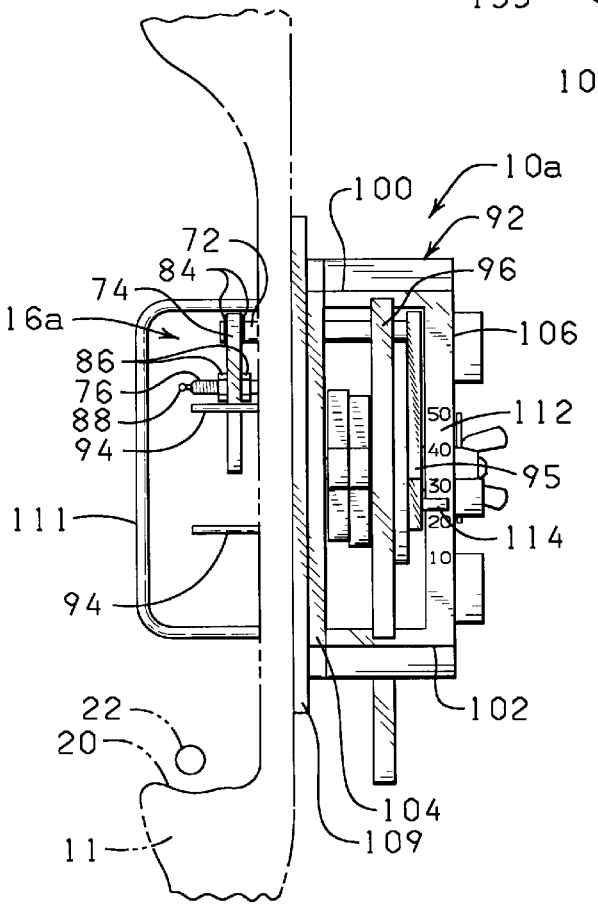
FIG. 6 is a rear view of the sight apparatus of FIG. 5 illustrating an archer's perspective of the sight apparatus when the bow is in a shooting position.

The mounting plate 109 further includes a pin guard 111. As best shown in FIG. 6, the pin guard 111 is a U-shaped member extending from the mounting plate 109 to prevent the pendulous sight 16*a* and the bracket pins 94 from being damaged. It will be appreciated that the pin guard 111 can be formed in a variety of other shapes.

As best seen in FIG. 6, the rear surface of the second side wall 106 is provided with indicia of distance 112 which are visible to an archer drawing the bow 11. A distance pointer 114 is attached to a rear area of the pendulum arm 95 to show the distance setting on the distance indicia 112.

Figure 5:
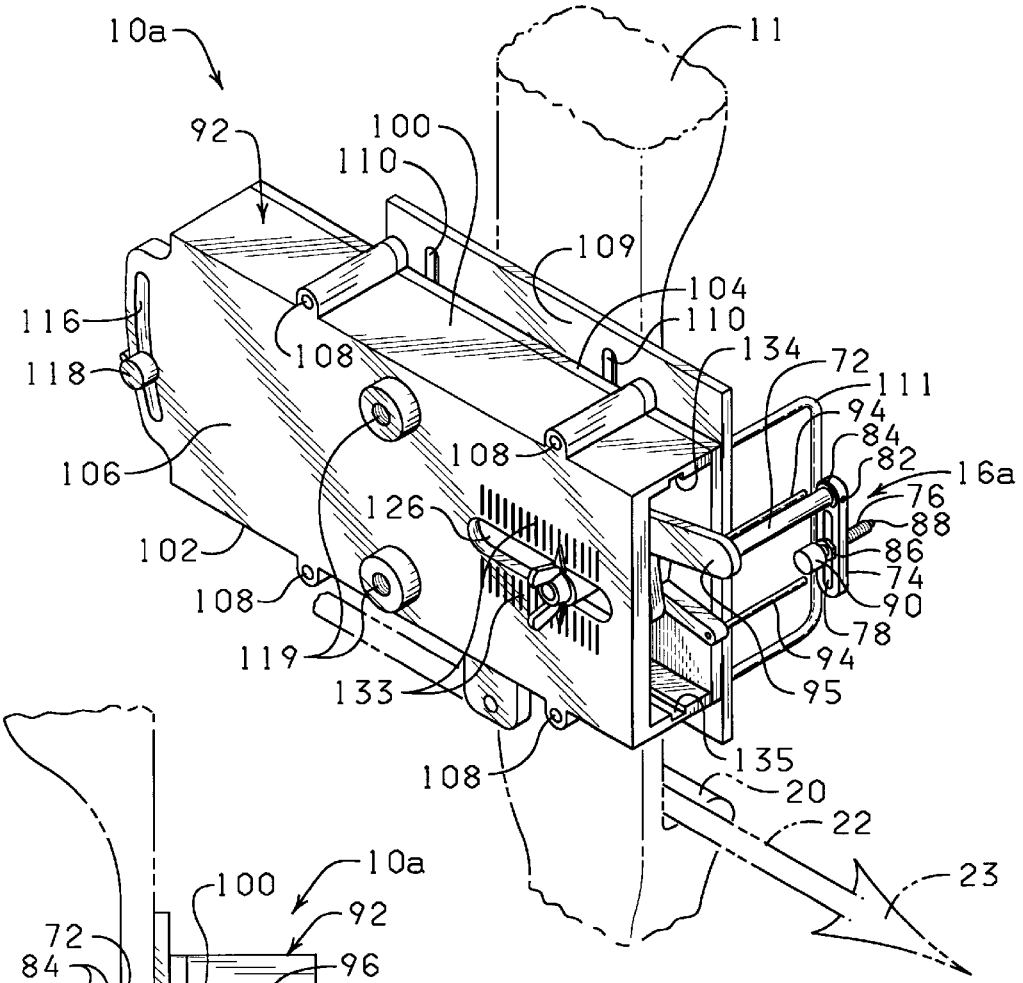
FIG. 5 is a perspective view of another embodiment of a sight apparatus constructed in accordance with the present invention shown attached to an archery bow.

As shown in FIG. 5, the second side wall 106 of the housing 92 has an arcuate slot 116 for receiving a set screw/knob 118 which is attached to the pendulum arm 95 for locking the sight apparatus 10*a* at a certain range setting, if desired. This construction is similar to that of the sight apparatus 10 disclosed hereinabove.

Threaded lugs 119 or the like are provided on the outer surface of the second side wall 106. These lugs 119 may be utilized for attachment of a quiver or any other component which may be used by an archer.

Figure 7:
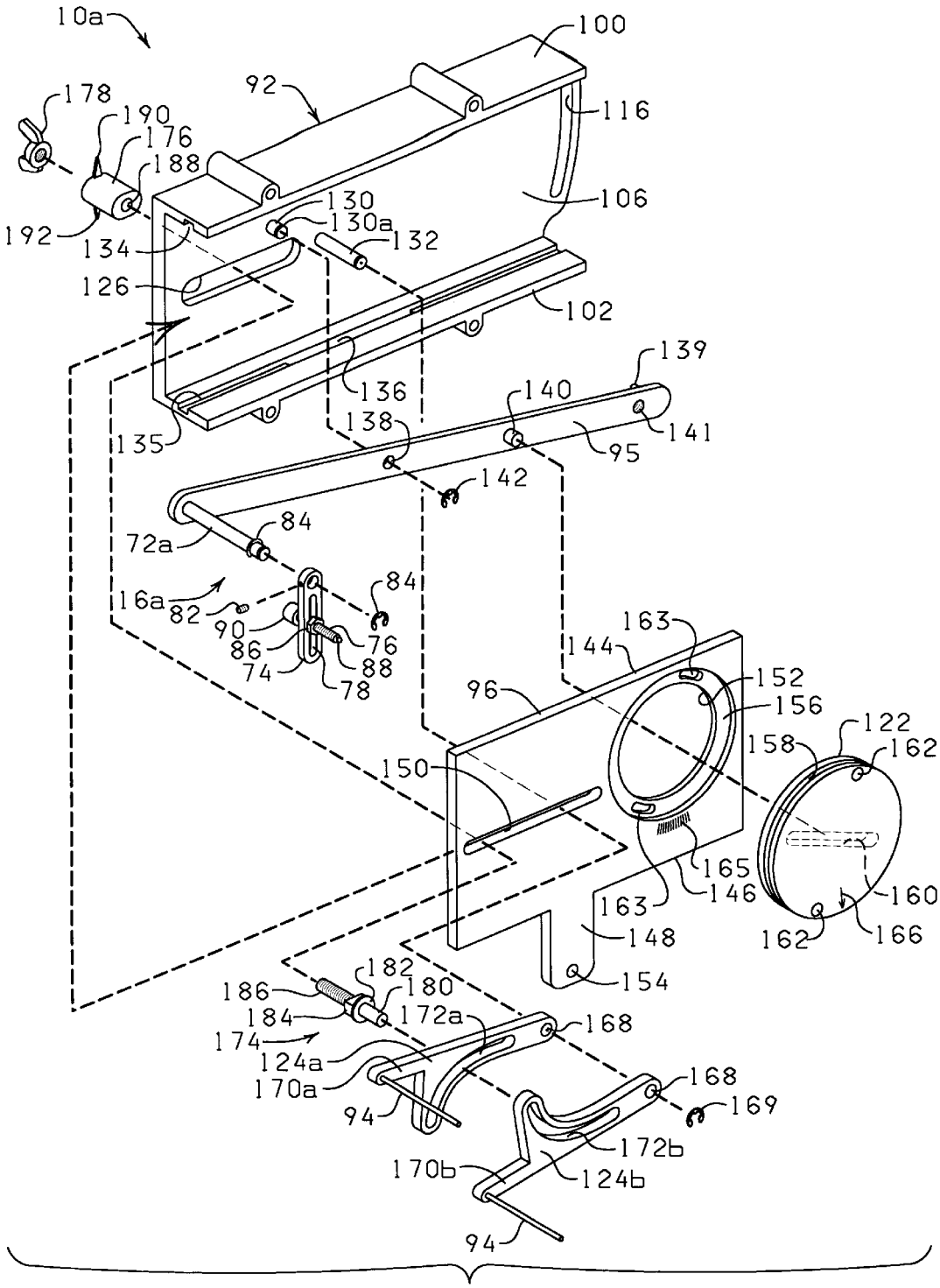
FIG. 7 is an exploded view of the sight apparatus of FIG. 5.
Figure 8:
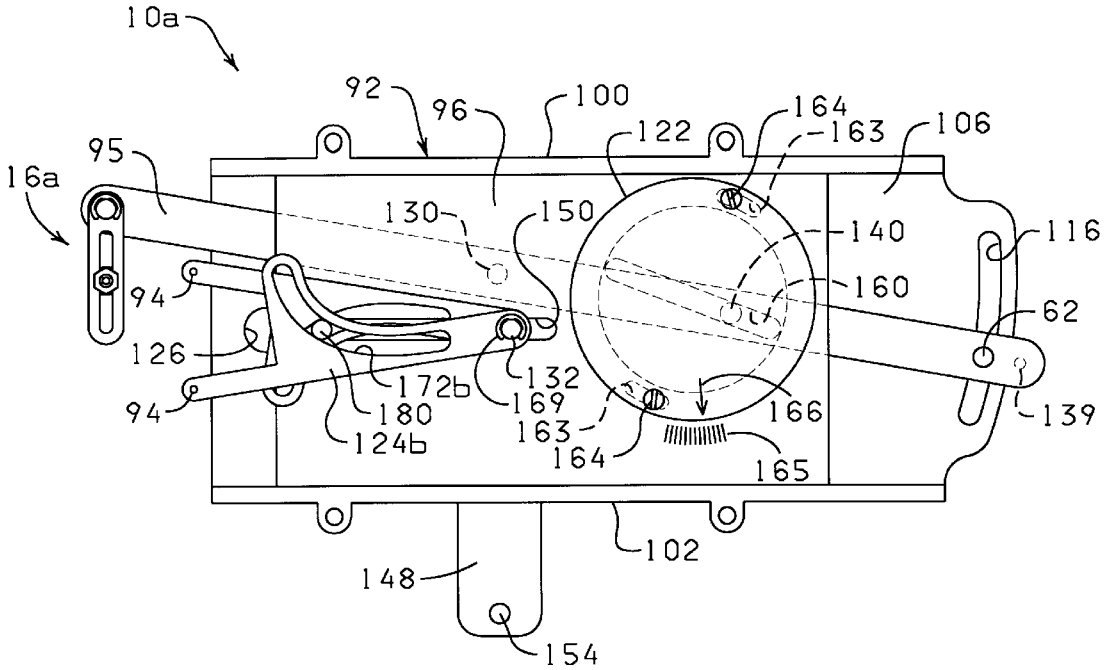
FIG. 8 is a side view of the sight apparatus of FIG. 5 with the near side of the housing removed illustrating the trigger plate in a forward position so as to open the bracket arms.
Figure 9:
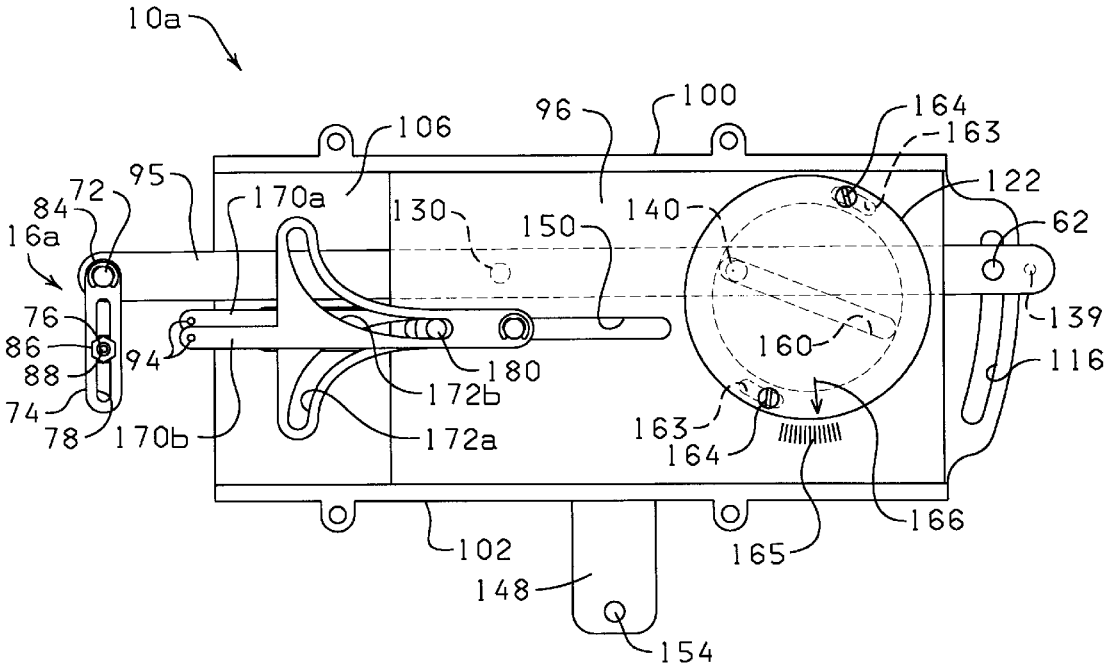
FIG. 9 is a side view of the sight apparatus of FIG. 5 with the near side of the housing removed illustrating the trigger plate in a rearward position so as to close the bracket arms.

With reference to FIG. 7, shown therein are the various components of the sight apparatus 10*a* in detail. The sight apparatus 10*a* includes the housing 92, the pendulum arm 95, the pendulous sight 16*a*, the trigger plate 96, an elevator disc 122, and a pair of bracket arms 124*a* and 124*b*.

In addition to the arcuate slot 116, the second side wall 106 of the housing 92 is provided with a control pin slot 126, a pendulum arm pivot pin 130 and a bracket arm pivot pin 132 which extends from the inner surface of the second side wall 106. Target size indicia 133 (FIG. 5) are provided on the outside of the second side wall 106 of the housing 92 to show the target size setting of the sight apparatus 10*a*. The target size indicia 133 may be located both above and below the control pin slot 126 to provide two sets of target size markings. Thus, the target sizes may be expressed on the target size indicia 133 in two differing manners, if desired.

The upper wall 100 is provided with a slide channel 134, and the lower wall 102 is provided with a slide channel 135. Each of the slide channels 134 and 135 is sized and shaped to receive an upper and lower portion of the trigger plate 96, respectively. A trigger slot 136 is provided in an intermediate portion of the slide channel 135 of the lower wall 102.

The pendulum arm 95 is an elongated bar having a pivot hole 138, a control pin 140, a support arm 72*a* for the pendulous sight 16*a*, a range pointer 139 and a set screw hole 141 for threadingly receiving the set screw 118 (shown in FIGS. 5 and 6). The pivot hole 138 of the pendulum arm 95 is sized and shaped to receive the pendulum arm pivot pin 130 of the housing 92.

Any suitable means may be employed to hold the pendulum arm 95 in position on the pendulum arm pivot pin 130. For example, an annular groove 130*a* may be provided around the pendulum arm pivot pin 130 and an E-clip 142 may be snapped into the groove 130*a* thereby pivotally receiving the pendulum arm 95 to the pivot pin 130.

The trigger plate 96 has an upper end 144, a lower end 146, a trigger handle 148, a pin slot 150 and an elevator disc opening 152. The upper end 144 and lower end 146 of the trigger plate 96 are sized and shaped to fit into the slide channels 134 and 135 of the upper and lower side walls 100 and 102 of the housing 92, respectively. The trigger handle 148 is disposed through the trigger slot 136 in the lower wall 102 of the housing 92 such that the trigger plate 96 is slidingly movable along the track defined by the slide channels 134 and 135 by moving the trigger handle 148 forward or rearward in the trigger slot 136. The trigger plate 96 can be moved by applying a force to the trigger handle 148 directly or by use of a trigger mechanism (not shown) connected to the trigger handle 148 via a mounting hole 154 provided in the trigger handle 148. Suitable trigger mechanisms are known in the art and may be used to provide a linkage between the trigger handle 148 and a finger or the thumb of an archer's bow-gripping hand. Using one of such trigger mechanisms, an archer is able to move the trigger handle 148 without removing the bow-gripping hand from the bow 11. In this manner, an archer may adjust the position of the trigger plate 96 while maintaining the bow 11 at full draw.

A shoulder 156 projects radially into the elevator disc opening 152. Complementary to the shoulder 156, an annular groove 158 extends radially into the elevator disc 122. When the elevator disc 122 is installed in the elevator disc opening 152, the shoulder 156 is disposed in the annular groove 158. Therefore, the shoulder 156 retains the elevator disc 122 in the elevator disc opening 152 and yet allows the elevator disc 122 to rotate clockwise and counter-clockwise within the elevator disc opening 152.

The elevator disc 122 is provided with a pendulum control slot 160 which extends across an inner portion of the elevator disc 122. A pair of threaded holes 162 are provided in the elevator disc 122 and a pair of disc adjustment slots 163 are formed in the shoulder 156 for receiving screws 164 (FIGS. 8 and 9) or other suitable fasteners to lock down the elevator disc 122 in a selected position.

Elevator indicia 165 are provided on the trigger plate 96 at the perimeter of the elevator disc opening 152. An elevator pointer 166 is disposed on the elevator disc 122 to indicate which of the elevator indicia 165 is the current setting for the elevator disc 122, or in other words, the current angle of the pendulum control slot 160.

Each of the bracket arms 124*a* and 124*b* has a pivot hole 168 for pivotally mounting the bracket arms 124*a* and 124*b* to the bracket arm pivot pin 132 with an E-ring 169. The bracket arm 124*a* has an upper bracket support arm 170*a* and a control slot 172*a* which curves generally upward from a forward point below the bracket support arm 170*a* to a rearward point substantially even with the bracket support arm 170*a*. Conversely, the bracket arm 124*b* has a lower bracket support arm 170*b* and a control slot 172*b* which curves generally downward from a forward point above the bracket support arm 170*b* to a rearward point substantially even with the bracket support arm 170*b*.

To effect movement of the bracket pins 94, a control pin 174, spacer 176 and wing nut 178 are provided. The control pin 174 has a cylindrical end portion 180 which extends into the control slots 172*a* and 172*b* of the bracket support arms 170*a* and 170*b*, respectively. The control pin 174 further includes a collar 182, a flat-sided portion 184, and a threaded portion 186. When assembled, the collar 182 engages the trigger plate 96, the flat-sided portion 184 is disposed in the control pin slot 150 of the trigger plate 96, and the threaded portion 186 receives the spacer 176 and wing nut 178.

The spacer 176 is flattened on top and bottom to prevent rotation of the spacer 176 within the control pin slot 126 of the second side wall 106 of the housing 92. It should be appreciated that the spacer 176 has a spacer bore 188 which is large enough for the spacer 176 to slide onto the threaded portion 186 of the control pin 174. In addition, the spacer 176 comprises an upper pointer 190 and a lower pointer 192 for indicating the bracket setting on the target size indicia 133 on the outside surface of the second side wall 106.

Setting up the sight apparatus 10*a* for the size of the target to be shot is best understood with reference to FIGS. 5 and 6. The wing nut 178 is used to set the bracket pins 94 in accordance with the size of the target to be shot.

In general, the wing nut 178 may be set for targets as large as about 36 inches and as small as approximately 12 inches at a distance of 30 yards. For example, a typical deer may measure about 18 inches from back to belly. Thus, for deer hunting, the wing nut 178 would be set for a target of about 18 inches. The target size indicia 133 on the outside of the second side wall 106 of the housing 92 shows the target size setting of the sight apparatus 10*a*. The wing nut 178 is moved forward or rearward and locked down to change the target size setting. The wing nut 178 secures the control pin 174 to the trigger plate 96 by tightening the spacer 176 and the collar 182 of the control pin 174 against opposite sides of the trigger plate 96. Thus, the spacer 176 slides back and forth in the control pin slot 126 with movement of the trigger plate 96.

The flat top and bottom of the spacer 176 keeps the spacer 176 from rotating as it travels in the control pin slot 126. Further, the flat top and bottom of the spacer 176 will engage the second side wall 106 at the upper and lower surfaces of the control pin slot 126 to keep the spacer 176 from turning when the wing nut 178 is turned. Similarly, the flat portion 184 of the control pin 174 will engage the trigger plate 96 at the upper and lower surfaces of the control pin slot 150 to keep the control pin 174 from turning when the wing nut 178 is turned.

When the control pin 174 is secured to the trigger plate 96 in a forward position, the bracket pins 94 are relatively far apart when the trigger plate 96 is all the way forward. Thus, a forward setting of the control pin 174 is for framing a large target. The bracket pins 94 move together as the trigger plate 96 is moved rearward as illustrated from the position shown in FIG. 8 to the position shown in FIG. 9. Conversely, when the control pin 174 is secured to the trigger plate 96 in a rearward position, the bracket pins 94 are close together when the trigger plate 96 is all the way forward. Thus, a rearward setting of the control pin 174 is for shooting at a small target. The bracket pins 94 move closer and closer together as the trigger plate 96 is moved rearward.

The setup and movement of the bracket pins 94 may be designed in a variety of ways. For example, the bracket arms 124 may be constructed such that one of the bracket pins 94 remains stationary and the other bracket pin 94 closes toward the stationary bracket pin 94 as the trigger plate 96 is moved rearward. In another variation, the bracket arms 124 may be constructed such that the bracket pins 94 close in response to forward movement of the trigger plate 96 and open in response to rearward movement of the trigger plate 96.

The setup of the pendulous sight 16*a* is best understood with reference to FIGS. 5–7. The setup affects the travel path of the pendulous sight 16 in response to movement of the trigger plate 96.

First, a target having a known size (such as 18 inches in height) is placed at a known distance (such as 30 yards ) from the shooting location. The target should be located at an elevation which is substantially the same as the elevation of the arrow rest 20 when the bow 11 is held in the shooting position by the archer.

Next, the screws 164 and the wing nut 178 are loosened and the pendulum arm 95 is locked with the set knob 118 to the known distance (such as 30 yards ) as displayed on the distance indicia 112 (FIG. 6). The trigger handle 148 is moved until the bracket pins 94 frame the target. The wing nut 178 is then tightened. Then, the screws 164 for the elevator disc 122 are tightened to lock the elevator disc 122 in place. Finally, arrows are shot at the target.

If the arrows miss the target, then the housing 92 is moved up or down to adjust the vertical position of the sight element 76 until the arrows hit the target. As an alternative to adjusting the housing 92, the sight element 76 may be vertically adjusted along the slot 78.

To check the elevator disc 122, the target is placed 10 yards back and arrows are shot again. If the arrows miss, the position of the elevator disc 122 is changed and another round of arrows are shot at the target. This process is repeated until the arrows hit the target.

When the arrows consistently hit the target, then the position of the elevator disc 122 is correct for the speed of the bow and the flight characteristics of the arrows being shot. Accordingly, setup of the pendulous sight 16*a* is completed for the known distance (30 yards ).

The elevator pointer 166 and the elevator indicia 165 show the correct setting for the elevator disc 122. The elevator indica 165 may be marked with wax or a marker to show the correct setting for the elevator disc 122. In this manner, the elevator disc 122 can easily be reset to the correct position by lining the elevator pointer 166 with the marked one of the elevator indicia 165 should the elevator disc 122 become accidentally unfastened and rotated.

It should be appreciated that the setup sequence may be performed for one or several distances. Further, it should be appreciated that the setup for the pendulous sight 16*a* need only be performed one time for a particular bow and arrow combination. There is no need to set up the pendulous sight 16*a* again unless the bow is changed to have a different bow speed or a change is made to arrows with different flight characteristics.

In use, the estimated or known distance to a target or the size of the target may be utilized in operating the sight apparatus 10*a*. In either case, the sight bead of the pendulous sight 16*a* is used as the point of aim at the target.

To sight according to estimated or known distance, the set knob 68 is locked to place the range pointer 58 at the estimated or known distance to the target. Then the sight bead of the pendulous sight 16*a* is utilized as the point of aim at the target. In this case, the bracket pins 94 are not used.

To sight according to target size, the set knob 68 is loosened and the trigger handle 148 is adjusted until the bracket pins 94 frame the target. Thus, the bracket pins 94 act as a range finder for a target having a particular vertical measurement (such as 18 inches for the measurement between the abdomen and back of a deer) Then the sight bead of the pendulous sight 16*a* is used as the point of aim at the target. In this case, the pendulum arm 95 and range pointer 114 float to compensate for elevational differences between the bow 11 and the target.

Figure 10:
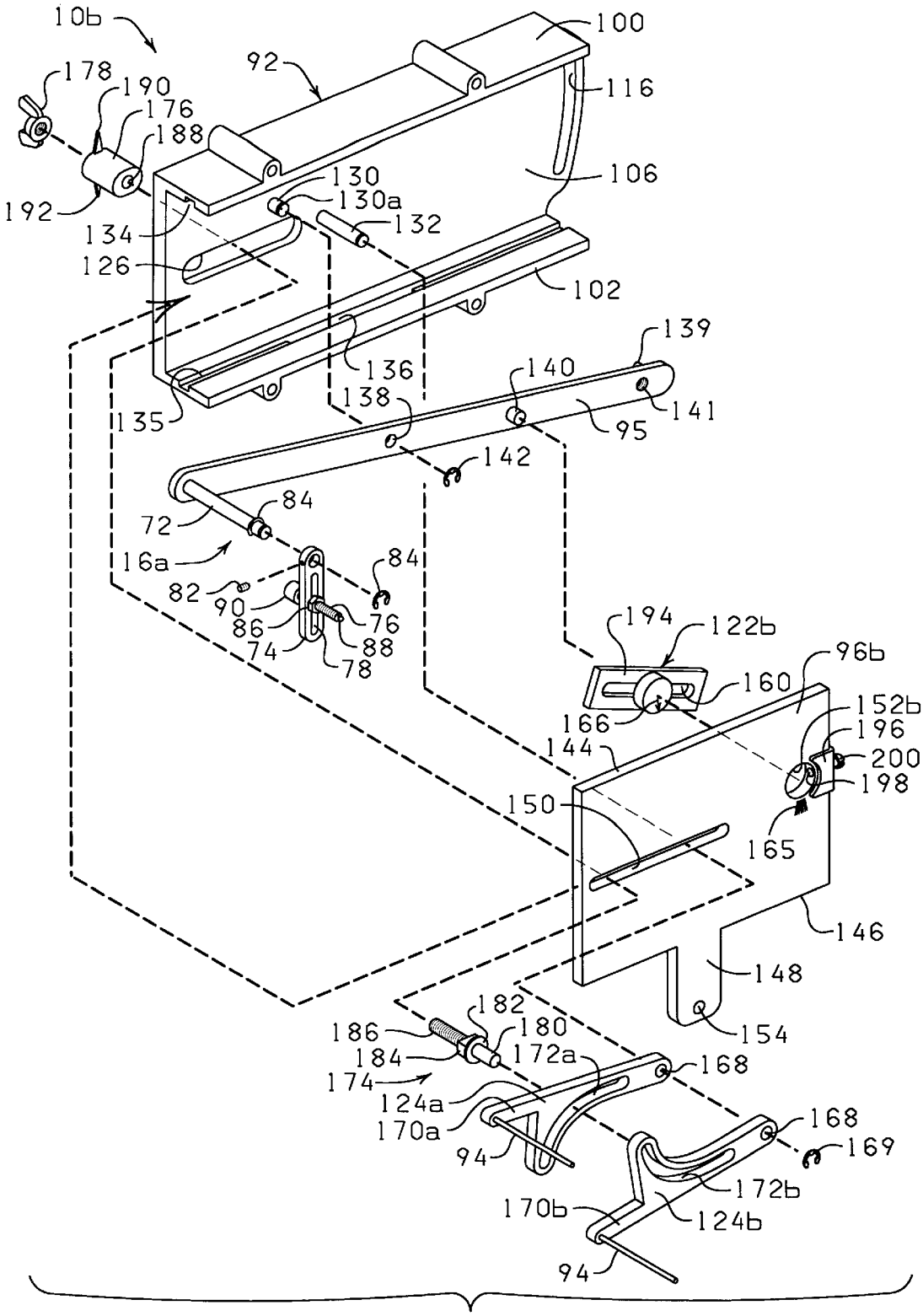
FIG. 10 is an exploded view showing a modified embodiment of the sight apparatus illustrated in FIGS. 5–9.

Embodiment of FIG. 10

With reference to FIG. 10, shown therein and designated by reference character 10*b* is a modified embodiment of the sight apparatus 10*a* constructed in accordance with the present invention. That is, the sight apparatus 10*b* is identical to the sight apparatus 10*a* except for having a modified trigger plate 96*b* and a modified elevator disc 122*b*.

The elevator disc 122*b* is smaller than the elevator disc 122. Further, the elevator disc 122*b* includes an attached elevator bar 194 which has the pendulum control slot 160.

The trigger plate 96*b* has an elevator disc opening 152*b* which is sized and shaped to receive the elevator disc 122*b*. Further, a set screw bracket 196, set screw hole 198 and set screw 200 are provided in the end of the trigger plate 96*b*. The set screw hole 198 extends from the end of the trigger plate 96*b* to the elevator disc opening 152*b* and is threaded to receive the set screw 200.

With this construction, the set screw 200 may be tightened against the elevator disc 122*b* to secure the elevator disc 122*b* in a selected position.

The position of the elevator disc 122*b* is made apparent by the elevator indicia 165 and the elevator pointer 166. It will be appreciated that turning the elevator disc 122*b* rotates the attached elevator bar 194 to alter the angle of the pendulum control slot 160. With the pendulum control pin 140 disposed in the pendulum control slot 160, the angle of the pendulum control slot 160 determines the travel path of the pendulous sight 16*a* as the trigger plate 96*b* is moved forward or rearward. In other aspects, the construction and operation of the sight apparatus 10*b* is exactly like that of the sight apparatus 10*a*.

Embodiment of FIGS. 11–17

Figure 11:
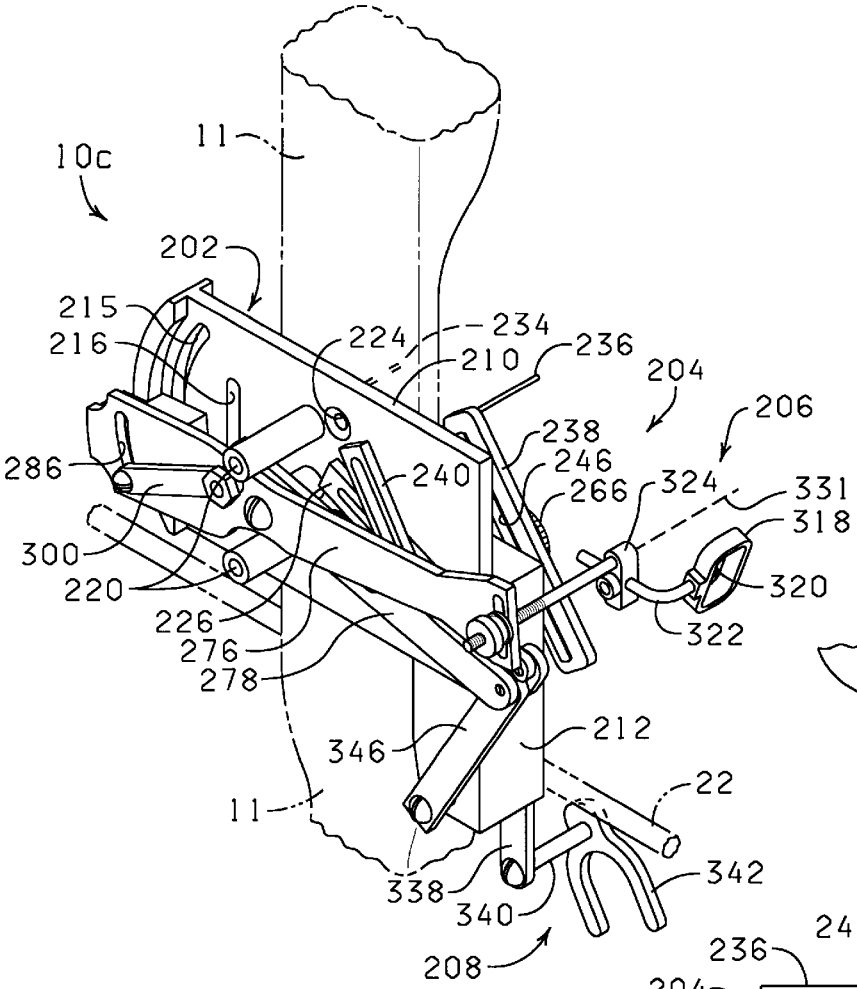
FIG. 11 is a perspective view of a preferred embodiment of a sight apparatus constructed in accordance with the present invention shown attached to an archery bow.
Figure 12:
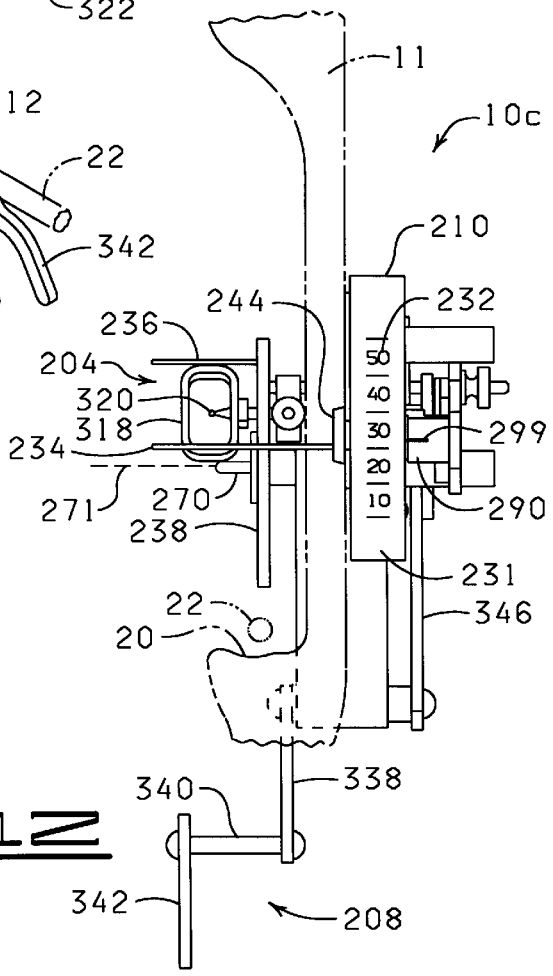
FIG. 12 is a rear view of the sight apparatus of FIG. 11.
Figure 13:
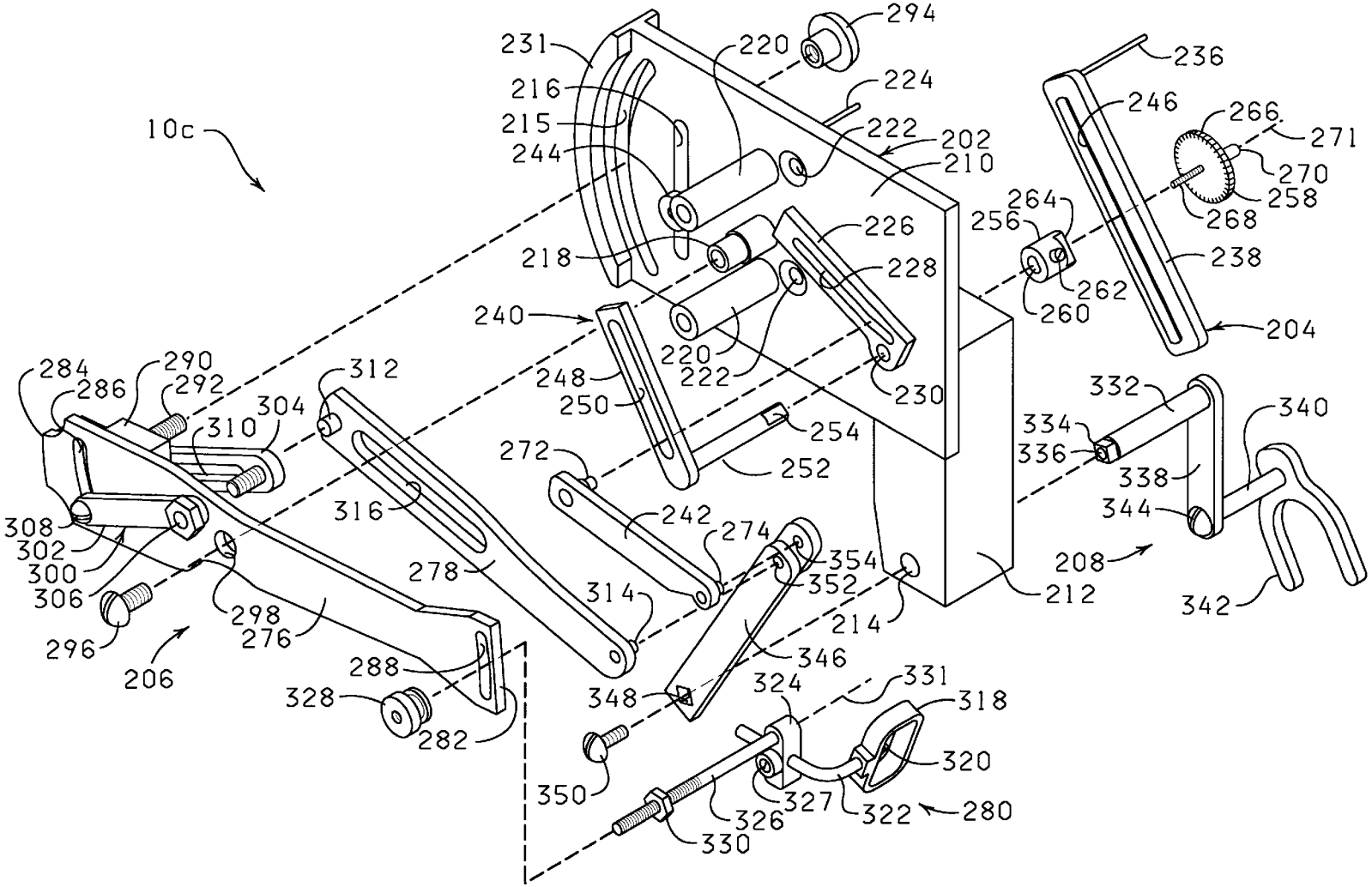
FIG. 13 is an exploded view of the sight apparatus of FIG. 11.

Referring now to FIGS. 11–13, a preferred embodiment of a sight apparatus 10*c* constructed in accordance with the present invention is illustrated. Broadly, the sight apparatus 10*c* includes a base assembly 202, a target bracketing assembly 204, a sight assembly 206, and a trigger assembly 208.

The base assembly 202 includes a base plate 210 and a base block 212. The base block 212 extends downward from the front end of the base plate 210 and is provided with a rod receiving hole 214 (FIG. 13) which extends through the base block 212. The base block 212 may be cast or molded with the base plate 210 or constructed separately and affixed to the base plate 210.

The base plate 210 is provided with an arcuate slot 215, a bracket pin support slot 216, a mounting shaft 218, a pair of accessory lugs 220, and a pair of attachment holes 222 (FIG. 13). The accessory lugs 220 are used for mounting bow accessories, such as a quiver, to the sight apparatus 10*c*. The attachment holes 222 are adapted to receive a pair of screws 224 (only one visible in FIG. 11) for securing the sight apparatus 10*c* to a bow, such as the bow 11.

The base plate 210 is further provided with a guide arm 226 having a guide slot 228. The guide arm 226 is disposed on the base plate 210 so that the guide slot 228 extends angularly across a portion of the base, substantially as shown in FIG. 13. The particular shape of the guide slot 228 is important for the proper operation of the sight apparatus 10*c* and will be discussed below in further detail. A hole 230 is provided adjacent the low end of the guide slot 228, and the hole 230 extends through the guide arm 226 and through the base plate 210. It will be appreciated that the guide arm 226 may be cast or molded in the base plate 210, machined in the side of the base plate 210, or constructed separately and affixed to the base plate 210.

In FIG. 12, the base plate 210 is shown to have an enlarged rearward end 231 which is arcuately shaped. The enlarged rearward end 231 supports distance indicia 232 which denotes the distance setting of the sight apparatus 10*c*. It will be appreciated by those skilled in the art that the shooting characteristics of a bow can vary depending on a number of factors, including the bow speed and the flight characteristics of the arrows being shot. Therefore, it may be preferable to have a strip of material which can be marked by the archer as the bow on which the sight apparatus 10*c* is attached is being calibrated. The calibration of the sight apparatus 10*c* will be discussed below.

The target bracketing assembly 204 includes a lower bracketing pin 234, an upper bracketing pin 236, a bracketing pin mounting arm 238 for supporting the upper bracketing pin 236, a bracketing control arm 240 for transmitting rotational movement to the bracketing pin mounting arm 238, and a pivot control arm 242 for transmitting a force to the bracketing control arm 240 from the trigger assembly 208.

The lower bracketing pin 234 is mounted to the base plate 210 so as to extend outwardly therefrom, as best shown in FIG. 12. The lower bracketing pin 234 is attached to the base plate 210 with a set bushing 244 which is sized to be disposed in the bracketing pin support slot 216 of the base plate 210. The set bushing 244 may be loosened such that the lower bracketing pin 234 may be selectively moved along the bracketing pin support slot 216 to a desired position. The proper positioning of the lower bracketing pin 234 will be discussed in further detail below.

The bracketing pin mounting arm 238 serves to support the upper bracketing pin 236 which is extended from one end of the bracketing pin mounting arm 238, as substantially shown in FIGS. 12 and 13. The bracketing mounting arm 238 is provided with an adjustment slot 246.

The bracketing pin mounting arm 238 is supported by the bracketing control arm 240. The bracketing control arm 240 is an L-shaped member which includes a pivot arm portion 248 provided with an elongated guide slot 250 and a pivot rod portion 252 extending perpendicular from one end of the pivot arm portion 248. The pivot rod portion 252 is sized to extend through the hole 230 of the guide arm 226 and the base plate 210. A distal end of the pivot rod portion 252 is provided with a flat surface 254.

The bracketing pin mounting arm 238 is connected to the distal end of the pivot rod portion 252 of the bracketing control arm 240 with a bushing 256 and a connecting member 258. The bushing 256 has a hole 260 shaped to matingly receive the distal end of the pivot rod portion 252. A set screw 262 is employed to secure the bushing 256 to the pivot rod portion 252. The bushing 256 is provided with a lug portion 264 which is flat on opposing sides and sized to fit into the adjustment slot 246 of the bracketing pin mounting arm 238 such that rotation of the bushing 256 transmits rotational movement to the bracketing pin mounting arm 238.

The connecting member 258 has a knob portion 266 with a threaded shaft 268 extending from one side thereof and an alignment pin 270 extending from the other side. The alignment pin 270 defines an axis of rotation 271 (FIG. 12) about which the upper bracketing pin 236 will rotate when a rotational force is applied to the pivot rod portion 252 of the bracketing control arm 240. The threaded shaft 268 is dimensioned to extend through the bushing 256 and threadingly engage a threaded bore (not shown) provided in the distal end of the pivot rod portion 252 of the bracketing control arm 240 and thereby causing the knob portion 266 to frictionally engage the bracketing pin mounting arm 238 to secure the bracketing pin mounting arm 238 in a selected position. That is, the upper bracketing pin 236 is radially adjustable relative to the axis of rotation 271 by loosening the connecting member 258 and sliding the bracketing pin mounting arm 238 on the bushing 256. It will be appreciated that by adjusting the radial position of the upper bracketing pin 236, the bracketing pins 234 and 236 may be quickly adjusted for targets of varying height.

The pivot control arm 242 is provided with a pair of pivot pins 272 and 274. The pivot pins 272 and 274 are located on the same side, but opposite ends, of the pivot control arm 242. The pivot pin 272 is sized to extend slidingly through the elongated guide slot 250 of the bracketing control arm 240 and into the guide slot 228 of the guide arm 226. The pivot pin 274 is adapted to be pivotally connected to the trigger assembly 208 whereby movement of the trigger assembly 208 imparts a force on the pivot control arm 242. The angular relationship of the guide slot 250 of the bracketing control arm 240 and the guide slot 228 of the guide arm 236 results in the pivot control arm 242 imparting a rotational force on the bracketing control arm 240 which in turn is transmitted to the bracketing pin mounting arm 238. The rotational movement of the bracketing pin mounting arm 238 causes the upper bracketing pin 236 to move toward or away from the lower bracketing pin 234 (depending on the direction in which the trigger assembly 208 is moved) along an arc shaped travel path 275 (FIG. 14) such that the lower and upper bracketing pins 234 and 236 can be used in conjunction with one another to bracket or frame a selected target and in turn function as a range finder. To this end, the arc shaped travel path 275 generally extends through an angle of about 90 degrees.

The sight assembly 206 includes a sight control arm 276, an elevator control arm 278, and a sight pin assembly 280, all of which cooperate to automatically set a point of aim at the correct position for the distance to the target in response to bracketing the target with the lower and upper bracketing pins 234 and 236 of the bracketing assembly 204 or by setting the sight apparatus 10*c* to correspond to a known distance.

The sight control arm 276 is an elongated member having a forward end 282 and a rearward end 284. The sight control arm 276 has an elevator adjustment slot 286 near the rearward end 284 and sight adjustment slot 288 near the forward end 282. A block member 290 is extended from the rearward end 284. The block member 290 is provided with a threaded shaft 292 which is slidingly disposed in the arcuate slot 215 of the base plate 210. To secure the sight control arm 276 in a selected position, a knob 294 is threaded onto the threaded shaft 292 and tightened so as to frictionally engage the base plate 210 and thus lock the sight control arm 276 in position.

The sight control arm 276 is pivotally attached to the base plate 210 via a connecting member 296 which is inserted through a pivot hole 298 provided in the sight control arm 276. With the sight control arm 276 connected to the base plate 210, the block member 290 is positioned adjacent the enlarged rearward end 231 of the base plate 210. As shown in FIG. 12, the block member 290 is provided with a range pointer 299 to indicate the distance to a target.

To control the degree of rotation of the sight control arm 276, an elevator assembly 300 is pivotally attached to the sight control arm 276. The elevator assembly 300 includes an outer arm 302 and an inner arm 304. The outer and inner arms 302 and 304 of the elevator assembly 300 are positioned on opposing sides of the sight control arm 276 with one end of the outer and inner arms 302 and 304 of the elevator assembly 300 pivotally connected to the sight control arm 276 and the other end of the outer and inner arms 302 and 304 positioned adjacent the elevator adjustment slot 286. A nut and bolt 306, or other suitable fastener, pivotally connect the outer and inner arms 302 and 304 to the sight control arm 276. A nut and bolt 308 retains the other end of the outer and inner arms 302 and 304 whereby the outer and inner arms 302 and 304 can be selectively locked in position along the elevator adjustment slot 286.

As shown in FIG. 13, the inner arm 304 of the elevator assembly 300 is provided with a guide slot 310.

The elevator control arm 278 serves to transmit motion of the trigger assembly 208 to the sight control arm 276. The elevator control arm 278 is an elongated member having a pin 312 extending from one end thereof which is adapted to be slidingly received in the guide slot 310 of the inner arm 304 and a pin 314 extending from the other end in the opposing direction and adapted to be pivotally connected to the trigger assembly 208. The elevator control arm 278 is further provided with a slot 316. The elevator control arm 278 is slidingly disposed on the mounting shaft 218 of the base plate 210 with the pin 312 slidingly disposed in the guide slot 310 of the inner arm 304. The pin 314 is connected to the trigger assembly 208 in a manner discussed below.

It will be appreciated that the nut and bolt 308 may be loosened and tightened to allow the elevator assembly 300 to be selectively positioned along the elevator adjustment slot 286 thereby easily changing the angle of the guide slot 310 of the inner arm 304 and in turn the degree of rotation of the sight control arm 276. As a consequence, the rotation of the sight control arm 276 can be adjusted for various bow and arrow weights and various arrow trajectories.

The sight pin assembly 280 includes a pin guard 318, a sight element 320, a mounting rod 322, a mounting block 324, and a support rod 326. The pin guard 318 is shown to be U-shaped. However, the pin guard 318 may have a wide variety of shapes, such as oval, circular, square, or rectangular.

The sight element 320 may comprise any suitable sight element known in the art including sight pins, sight beads or cross hairs. However, a sight element with an illuminated, luminescent or phosphorescent tip is preferred for improved visibility in poor light. Further, the lower and upper bracketing pins 234 and 236 of the bracketing assembly 204 can be coated with a luminescent material to enhance their visibility.

The mounting rod 322 extends through the mounting block 324 and is secured thereto with a set screw 327. The support rod 326 extends through the sight adjustment slot 288 of the sight control arm 276 and is fastened at a selected location along the sight adjustment slot 288 with a set knob 328 and lock nut 330. The mounting block 324 is pivotally connected to the end of the support rod 326 such that the support rod 326 defines a pivot axis 331. Thus, the mounting block 324 which carries the mounting rod 322, the pin guard 318, and the sight element 320, freely pivots on the support rod 326 and thus functions in a pendulous manner to adjust the position of the sight element 320 for elevational differences between the bow and the target.

The trigger assembly 208 includes a pivot rod 332 adapted to be pivotally disposed in the rod receiving hole 214 of the base block 212. The pivot rod 332 has a squared end 334 with a threaded bore 336 disposed therein. A mounting arm 338 is attached to the opposing end of the pivot rod 332, and a mounting rod 340 is attached to the mounting arm 338. A trigger 342 is connected to the mounting rod 340. The trigger 342 is adapted to receive the finger of an archer and thus may have a wide variety of shapes, including looped, U-shape, or arcuate shape. The mounting rod 340 may be removably attached to the mounting arm 338 with a screw 344, or the like, so that the trigger 342 may be interchanged with other shaped triggers, if desired.

To link the pivot rod 332 with the pivot control arm 242 of the bracketing assembly 204 and the elevator control arm 278 of the sight assembly 206, the trigger assembly 208 further includes a trigger arm 346. The trigger arm 346 has a first end with a hole 348 adapted to matingly receive the squared end 334 of the pivot rod 332. The trigger arm 346 is fixed to the pivot rod 332 with a connecting member 350. A second end of the trigger arm 346 is provided with a sight link receiving hole 352 and a bracketing link receiving hole 354; each being sized to pivotally receive the pin 314 of the elevator control arm 278 and the pin 274 of the pivot control arm 242, respectively. The second end of the trigger arm 346 is recessed or notched to receive the end of the pivot control arm 242 when the pivot control arm 242 is connected to the trigger arm 346.

The components of the sight apparatus 10*c* are preferably dimensioned such that the upper bracketing pin 236 moves along the entire length of the arc shaped travel path 275 in conjunction with the trigger 342 being moved through a range of about 1¼ inches with each ¼ inch of trigger travel causing the bracketing assembly 204 and the sight assembly 206 to adjust for a distance increment of 10 yards. To this end, it will be appreciated by those of skill in the art that the shape of the guide slot 228 is a function of the apparent height of the target for a selected distance and the desired ratio of trigger travel to distance increment. That is, the apparent height of an object decreases as the distance of the object from the point of sight is increased. However, the apparent height does not decrease in a linear manner for each incremental increase in distance. For example, the apparent height of an object at a distance of 20 yards is about 50% of the apparent height of the object at 10 yards. However, the apparent height of the object at 30 yards is only about 66% of the apparent height of the object at 20 yards. Further, the apparent height of the object at 40 yards is only about 75% of the apparent height of the object at 30 yards, and the apparent height of the object at 50 yards is only about 80% of the apparent height of the object at 40 yards. In view of this relationship, it will be appreciated that the bracketing pin mounting arm 238 can not be rotated at equal angles for each incremental movement of the trigger 342. Instead, the bracketing pin mounting arm 238 must be moved along the arc shaped travel path 275 (FIG. 14) through differing degrees of rotation for each 10 yard distance increment. Thus, the guide slot 238 is shaped to cause the upper bracketing pin 236 to move through the appropriate angle of rotation in response to an incremental movement of the trigger 342.

When the sight apparatus 10*c* is assembled, movement of the trigger 342 imparts a rotational movement to the trigger arm 346 which simultaneously drives the pivot control arm 242 and the elevator control arm 278. Movement of the pivot control arm 242 causes the pivot pin 272 of the pivot control arm 242 to travel along the guide slot 228 of the guide arm 226 and the guide slot 250 of the bracketing control arm 240 thereby causing the pivot pin 272 to engage the bracketing control arm 240 so as to rotate the bracketing control arm 240. Rotation of the bracketing control arm 240 is transmitted to the bracketing pin mounting arm 238 and the upper bracketing pin 236 through the bushing 256 thereby rotating the upper bracketing pin 236.

Movement of the elevator control arm 278 causes the elevator control arm 278 to slide over the mounting shaft 218 of the base plate 210 and the pin 312 to travel along the guide slot 310 of the elevator assembly 300 thereby causing the pin 312 to engage the elevator assembly 300 so as to rotate the sight control arm 276 about the mounting shaft 218 of the base 210. Rotation of the sight control arm 276 lowers or raises the forward end 282 of the sight control arm 276 so as to position the sight element 320 to provide a proper point of aim at a target upon the lower and upper bracketing pins 234 and 236 being framed about the target.

Operation

To calibrate the sight apparatus 10*c*, the lower bracketing pin 234 is positioned so that it is in the line of sight of an archer and the alignment pin 270 when the bow 11 is at full draw. Next, the position of the elevator assembly 300 is estimated. In general, for low speed bows, the elevator assembly 300 will be positioned so that the angular relationship of the guide slot 310 relative to the control arm 276 will be greater than the angular relationship for higher speed bows. Next, a target having a known size (such as 18 inches in height, for example) is placed at a known base distance which is generally 10 yards from the shooting location. The upper bracketing pin 236 is then radially adjusted relative to the alignment pin 270 to bracket or frame the target with the upper bracketing pin 236 and the lower bracketing pin 234. It will be appreciated that the bracketing pin mounting arm 238 can be provided with marks (not shown) that represent various target sizes.

Next, arrows are shot at the target. If the arrows miss the target, then the position of the sight assembly 206 is adjusted until the arrows hit the target.

To check whether the elevator assembly 300 is correctly positioned, the target is placed at a distance of 20 yards, for example, and the target is again bracketed between the lower and upper bracketing pins 234 and 236 using the trigger assembly 208. If arrows hit the intended spot on the target, the setting of the elevator assembly 300 is correct for the speed of the bow and the flight characteristics of the arrows being shot. Accordingly, setup of the sight apparatus 10*c* is completed. If the arrows miss the target, the position of the elevator assembly 300 is adjusted. That is, if the arrows miss high, the elevator assembly 300 is adjusted to rotate the elevator assembly 300 upward along the elevator adjustment slot 286 thereby reducing the travel of the sight assembly 206 for an incremental movement of the trigger assembly 208. Conversely, if the arrows miss low, the position of the elevator assembly 300 is adjusted to rotate the elevator assembly 300 downward along the elevator adjustment slot 286 thereby increasing the travel of the sight assembly 206 for an incremental movement of the trigger assembly 208. Once the elevator assembly 300 is adjusted, the position of the sight assembly 206 should be rechecked at 10 yards and adjusted accordingly if the arrows miss the target at 10 yards.

It should be appreciated that the calibration sequence may be performed for one or several distances. Further, it should be appreciated that the setup for the sight apparatus 10*c* need only be performed one time for a particular bow and arrow combination. There is no need to calibrate the sight apparatus 10*c* again unless the bow is changed to have a different bow speed or a change is made to arrows with different flight characteristics.

In use, the known distance to a target or the size of the target may be utilized in operating the sight apparatus 10*c*. In either case, the sight element 320 of the sight assembly 206 is used as the point of aim at the target.

To sight according to target size, the trigger 342 is manipulated until the lower and upper bracketing pins 234 and 236 frame the target. Thus, the bracketing pins 234 and 236 act as a range finder for a target having a particular vertical measurement (such as 18 inches for the measurement between the abdomen and back of a deer). Then the sight element 320 is used as the point of aim at the target. The pendulous characteristic of the sight element 320 compensates for elevational differences between the bow 11 and the target.

To sight according to the known distance, the trigger is manipulated to align the range pointer 299 with the known distance to the target. Then the sight element 320 is utilized as the point of aim at the target.

Figure 14:
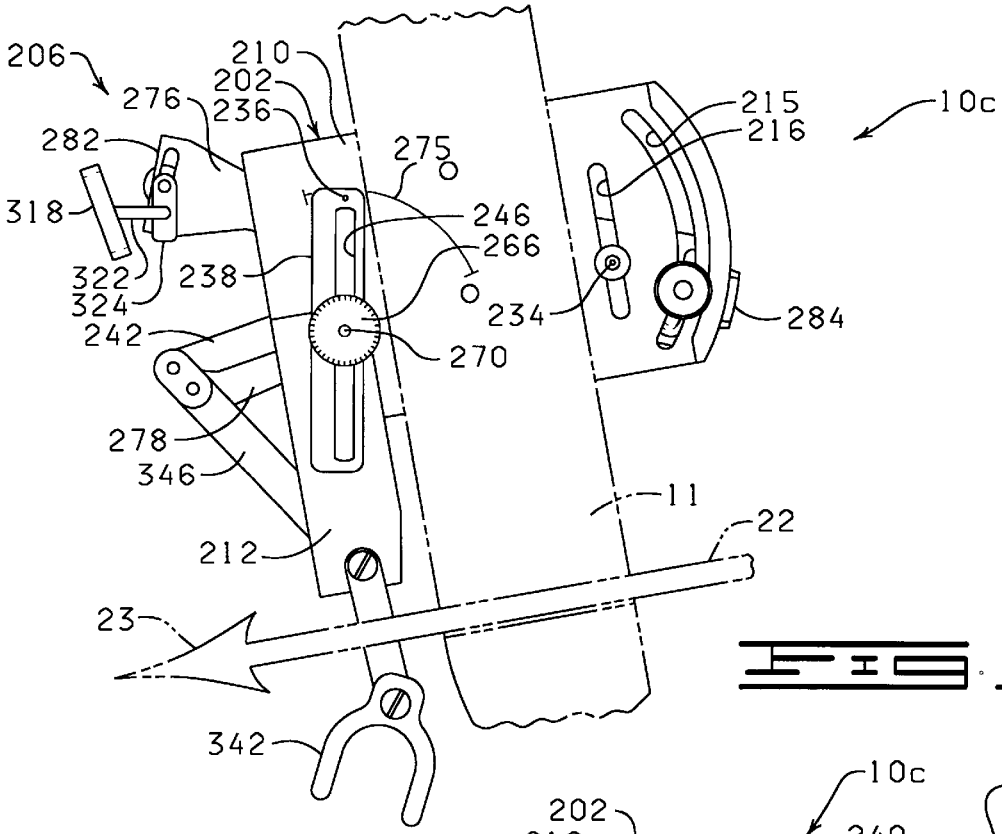
FIG. 14 is an elevational view of one side of the sight apparatus shown in FIG. 11 illustrating the sight apparatus positioned for shooting at a short-range target which is at a lower elevation than the sight apparatus.
Figure 15:
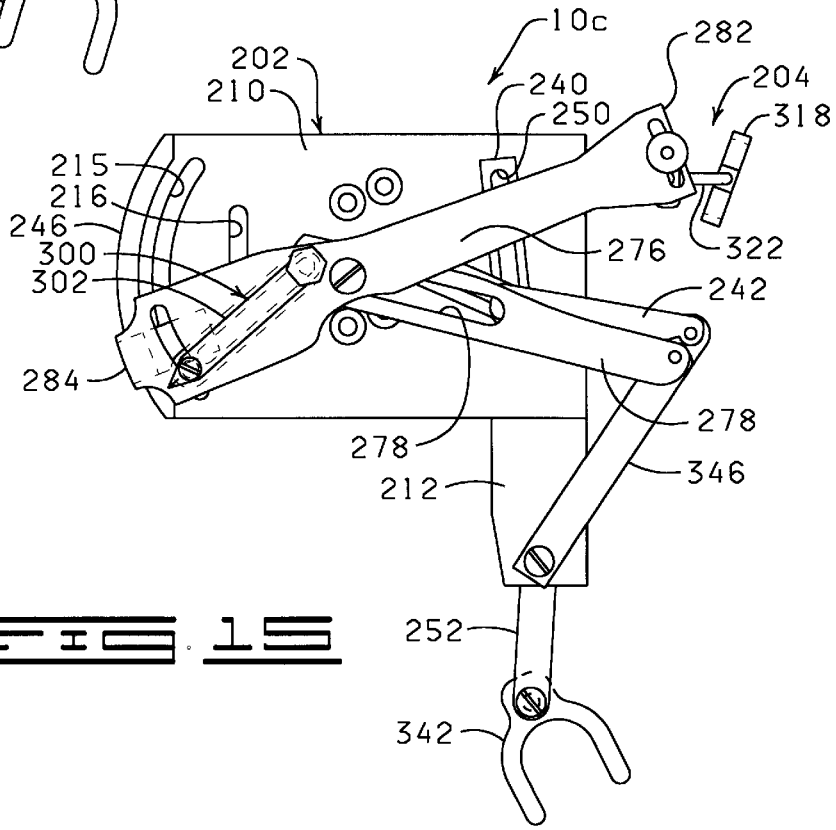
FIG. 15 is an elevational view of the opposite side of the sight apparatus of FIG. 14 with the bow removed for clarity.

To illustrate the sight apparatus 10*c* in operation, reference is made to FIGS. 14–17. In FIGS. 14 and 15, the sight apparatus 10*c* is providing a point of aim at a close range target. The bracketing pin mounting arm 238 is rotated such that the upper bracketing pin 236 is at an upper position. Thus, the vertical distance between the lower and upper bracketing pins 234 and 236 is at maximum since the target at close range appears larger than the same target at long range.

The rearward end 284 of the sight control arm 276 is toward the lower end of the arcuate slot 215, providing a visual indication on the distance indicia 232 (FIG. 12) that the target is at close range. The forward end 282 of the sight control arm 276 is raised to locate the sight element 320 (FIG. 12) at a proper position for aiming at a close range target.

In FIG. 14, the sight apparatus 10*c* is tilted downward from horizontal to illustrate the position of the bow 11 and the sight apparatus 10*c* when shooting at a target at a lower elevation than the sight apparatus 10*c*. In this case, the mounting block 324 has swung pendulously to adjust the position of the sight element 320 for the difference in elevation to the target.

Figure 16:
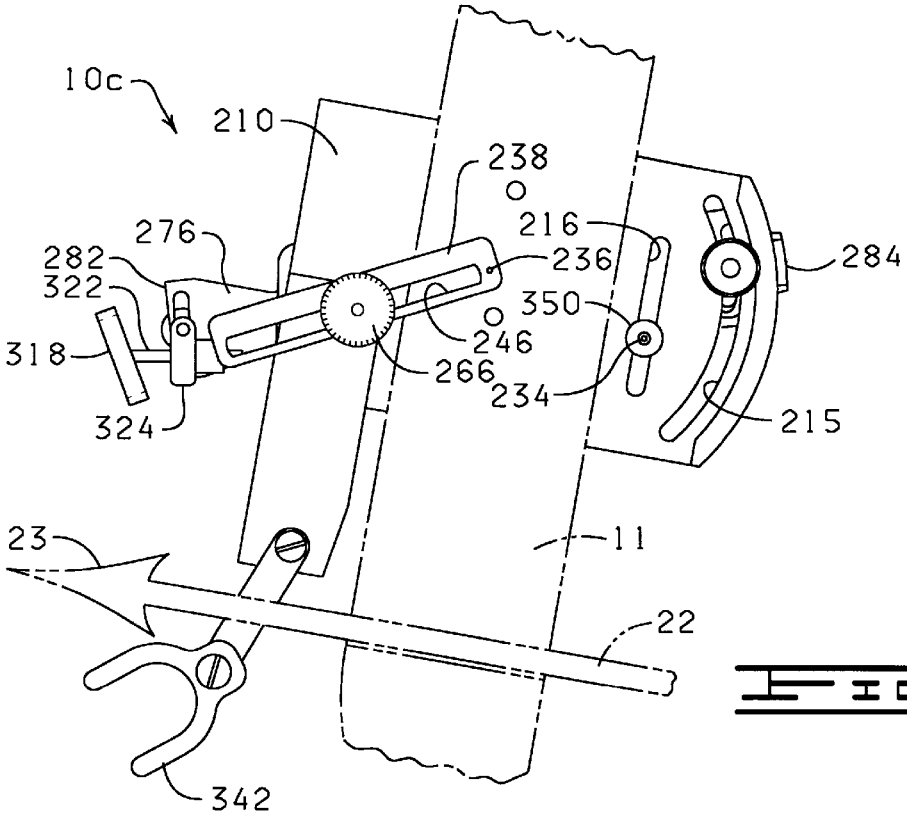
FIG. 16 is an elevational view of one side of the sight apparatus of FIG. 11 illustrating the sight apparatus positioned for shooting at a long-range target which is at a higher elevation than the sight apparatus.
Figure 17:
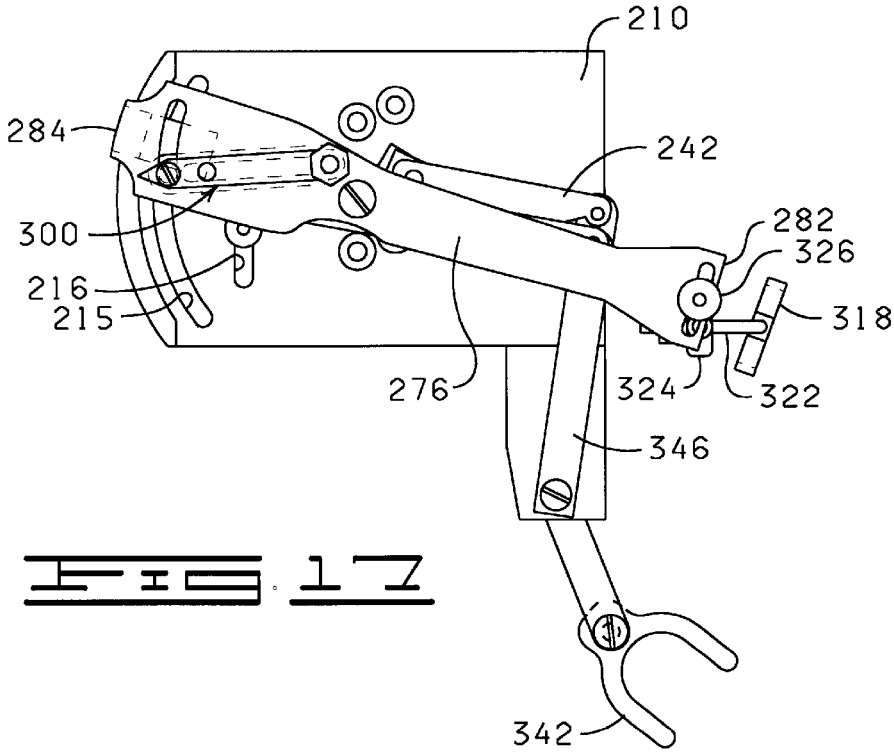
FIG. 17 is an elevational view of the opposite side of the sight apparatus of FIG. 16 with the bow removed for clarity.

With reference to FIGS. 16 and 17, the sight apparatus 10*c* is providing a point of aim at a long range target. The bracketing pin mounting arm 238 is rotated such that the upper bracketing pin 236 cooperates with the lower bracketing pin 234 to frame the target.

The rearward end 284 of the sight control arm 276 is toward the upper end of the arcuate slot 215, providing a visual indication on the distance indicia 232 that the target is at long range. The forward end of the sight control arm 276 is lowered to locate the sight element 320 at a proper position for aiming at a long range target.

In FIG. 16, the sight apparatus 10*c* is tilted upward from horizontal to illustrate the position of the bow 11 and the sight apparatus 10*c* when shooting at a target at a higher elevation than the sight apparatus 10*c*. In this case, the mounting block 324 has swung pendulously to adjust the position of the sight element 320 (FIG. 12) for the difference in elevation to the target.

One of the advantages of the sight apparatus 10*c* is that the rotational movement of the upper bracketing pin 236 enables the sight apparatus 10*c* to be quickly and easily adjusted for targets of different sizes by simply changing the radial position of the upper bracketing pin 236 relative to the axis about which the upper bracketing pin 236 rotates. To this end, it will be appreciated by those skilled in the art that the sight apparatus 10*c* can be adjusted to accommodate different size targets without requiring the sight apparatus 10*c* to be disassembled and parts interchanged.

Another advantage of the sight apparatus 10*c* is that guesswork required when shooting from an elevated position at ranges over about 30 yards is eliminated by the repositioning of both the sight element and the pivot axis. It will further be appreciated that the sight apparatus 10*c* has features which allow the sight apparatus 10*c* to be easily calibrated for a wide range of bow speeds, arrow weights and arrow types.

From the above description it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and as defined in the appended claims.

What is claimed is:

1. A sight apparatus for an archery bow, comprising:

a sight element positionable substantially adjacent the archery bow to provide a point of aim to a target;

a pair of spaced apart bracketing pins;

means for selectively moving at least one of the bracketing pins along an arc shaped travel path to vary the spacing of the bracketing pins so that one of the bracketing pins is alignable with an upper portion of the target and the other bracketing pin is alignable with a lower portion of the target so as to bracket the target and thereby determine the distance to the target, the arc shaped travel path of the bracketing pin being concentric with an axis of rotation and the axis of rotation being in alignment with the other bracketing pin and a line of sight of an individual when shooting the archery bow, the bracketing pin being radially adjustable relative to the axis of rotation so as to vary the arc shaped travel path of the bracketing pin to alter the spacing of the bracketing pins according to the size of the target; and means for moving the sight element in conjunction with the arced movement of the bracketing pin such that the sight element is positioned to provide a point of aim at the target when the bracketing pins are positioned to bracket the target.

2. The sight apparatus of claim 1 further comprising a base plate attachable to the archery bow, and wherein the means for moving the sight element comprises:

a sight control arm pivotally attached to the base plate, the sight element being attache to one end of the sight control arm; and elevator means for controlling the degree of rotation of the sight control arm.

3. The sight apparatus of claim 1 wherein the sight element is pendulously suspended from the means for moving the sight element so as to define a pivot axis which is positioned in conjunction with the positioning of the sight element so that the point of aim is adjusted for the distance to the target and the elevation of the target.

4. A sight apparatus for an archery bow, comprising:

a sight element positionable substantially adjacent the archery bow to provide a point of aim to a target;

a base plate attachable to the archery bow;

a pair of spaced apart bracketing pins;

means for selectively moving at least one of the bracketing pins along a travel path to vary the spacing of the bracketing pins so that one of the bracketing pins is alignable with an upper portion of the target and the other bracketing pin is alignable with a lower portion of the target so as to bracket the target and thereby determine the distance to the target;

means for selectively varying the travel path of the bracketing pin so as to alter the spacing of the bracketing pins according to the size of the target; and means for moving the sight element in conjunction with movement of the bracketing pin such that the sight element is positioned to provide a point of aim at the target when the bracketing pins are positioned to bracket the target, the means for moving the sight element comprising:

a sight control arm pivotally attached to the base plate, the sight element being attached to one end of the sight control arm; and elevator means for controlling the degree of rotation of the sight control arm.

5. The sight apparatus of claim 4 wherein the sight element is pendulously suspended from the means for moving the sight element so as to define a pivot axis which is positioned in conjunction with the positioning of the sight element so that the point of aim is adjusted for the distance to the target and the elevation of the target.

* * * * *